US007267108B2

(12) United States Patent
Barylski et al.

(10) Patent No.: US 7,267,108 B2
(45) Date of Patent: Sep. 11, 2007

(54) FUEL SYSTEM PRESSURE RELIEF VALVE WITH INTEGRAL ACCUMULATOR

(75) Inventors: Gary Barylski, Woodhaven, MI (US); Scott DeRaad, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 165 days.

(21) Appl. No.: 11/108,948

(22) Filed: Apr. 18, 2005

(65) Prior Publication Data

US 2006/0231078 A1 Oct. 19, 2006

(51) Int. Cl.
*F02M 69/54* (2006.01)
*F02M 69/52* (2006.01)

(52) U.S. Cl. ..... 123/457; 123/463

(58) Field of Classification Search ..... 123/447, 123/456, 457, 463, 497, 446; 137/610, 907, 137/509, 511, 906
See application file for complete search history.

(56) References Cited

U.S. PATENT DOCUMENTS 4,590,903 A * 5/1986 Hofmann et al. ..... 123/300
4,628,957 A 12/1986 Hofer et al.
4,633,836 A 1/1987 Faupel
5,477,829 A * 12/1995 Hassinger et al. ..... 123/467
5,537,980 A 7/1996 Yamamoto
5,590,631 A 1/1997 Tuckey
5,673,670 A * 10/1997 Powell et al. ..... 123/463
5,701,869 A 12/1997 Richardson et al.
5,797,374 A * 8/1998 Minagawa et al. ..... 123/497
5,839,413 A 11/1998 Krause et al.
5,845,623 A 12/1998 Blizard et al.
6,234,128 B1 5/2001 Reuss
6,352,067 B1 * 3/2002 Genslak ..... 123/510
6,378,505 B1 4/2002 Doering et al.
6,412,476 B1 7/2002 Thompson et al.
6,497,217 B2 12/2002 Kojima
7,066,152 B2 * 6/2006 Stroia et al. ..... 123/467
2001/0039944 A1 11/2001 Braun et al.
2004/0144085 A1 7/2004 Sumilla et al.
2004/0250795 A1 * 12/2004 Stroia et al. ..... 123/447
2006/0169251 A1 * 8/2006 Mori et al. ..... 123/446

* cited by examiner

*Primary Examiner*—Mahmoud Gimie
(74) *Attorney, Agent, or Firm*—Allan J. Lippa; Alleman Hall McCoy Russell & Tuttle LLP

(57) ABSTRACT

A fuel pressure relief system in an engine fuel system having a fuel line is shown. In one example, the system has a pressure relief valve in the fuel line; and a pressure relief assembly coupled to the relief valve, the assembly having an accumulator in communication with the engine side of the fuel line at least during engine off conditions.

18 Claims, 6 Drawing Sheets

FUEL SYSTEM PRESSURE RELIEF VALVE WITH INTEGRAL ACCUMULATOR

FIELD

The present application relates to the field of automotive fuel systems.

BACKGROUND

Engines typically have a fuel system to store, pressurize, filter, and deliver fuel to the engine. The fuel system may use a pump to deliver fuel from the tank through a filter to the fuel control unit. The fuel control unit then feeds the fuel into the fuel pressure regulator which maintains the liquid fuel pressure being supplied to the engine. In order to run efficiently, the fuel received by the engine should quickly reach a specific pressure when the engine is started and maintain that pressure during operation.

However, pressure regulation issues may occur when a hot engine is turned off. For example, after an engine is turned off, the temperature of the engine and related components may continue to rise for a period of time as the engine undergoes a period of "heat soak." A heat soak, or a hot soak, can cause fuel to boil inside the fuel lines and fuel filter. This may cause expansion of the vapor and any air in the vapor space, along with an increase in partial pressure of the fuel vapor. The pressure from the vaporized fuel, in turn, may push any liquid fuel remaining in the fuel lines back into the fuel tank. This can result in degraded start quality and increased emissions during a subsequent start.

In order to address this issue, some fuel systems incorporate a check valve between the pump and the fuel tank to reduce the amount of fuel that is pushed back to the fuel tank. However, this check valve still opens at a prescribed pressure and thus may still result in liquid fuel being pushed back into the fuel tank if the fuel pressure rises high enough. In other words, even with a check valve, vaporization of the fuel remaining in the fuel line may still occur, and fuel between the check valve and the fuel tank may run back to the fuel tank. As such, there still may be a potential for degraded start quality and increased emissions during a subsequent start.

Furthermore, the inventors herein have recognized that when using such a check valve, releasing the vapor pressure may also decrease the fuel pressure in the fuel delivery system once the system cools. Thus, not only does such a system allow for fuel to be pushed into the tank if temperature rises high enough, it also results in decreased pressure in the fuel line after the system cools. As a result, the operating pressure of the fuel system upon restart may take longer to reach a desired pressure or may be lower than expected, and this low pressure may result in degraded combustion, thereby increasing emissions and possibly contributing to poor start quality.

SUMMARY

In one embodiment, at least some of the above disadvantages may be achieved by a fuel pressure relief system in an engine fuel system having a fuel line comprising: a pressure relief valve in the fuel line; and a pressure relief capsule coupled to the relief valve, the capsule having an accumulator in communication with the engine side of the fuel line at least during engine off conditions. Various types of relief valves may be used, such as, for example, ball valves, spring loaded valves, electronically controlled valves, or others.

Further, various types of capsules and/or accumulators may be used, such as, for example, spring loaded accumulators, electronically controlled accumulators, or others.

In one example, the pressure relief capsule can enable volume expansion in the fuel lines experiencing increased pressure, thereby reducing the amount of expelled fuel through the pressure relief valve. Furthermore, the pressure relief capsule can enable volume contraction in the fuel lines upon a decrease in pressure, thereby reducing low pressure conditions upon subsequent restarts.

In another embodiment, at least some of the above disadvantages may be achieved by a method of maintaining pressure in a fuel delivery system of an engine on a vehicle traveling on the road comprising: capturing expanding vapor volume in the fuel line of the engine in a pressure relief capsule coupled to the pressure relief mechanism while the pressure relief mechanism is closed; and releasing pressure from the pressure relief capsule when the fuel line is in need of pressure.

In still another embodiment, at least some of the above disadvantages may be achieved by a method of compensating for pressure variation in a fuel delivery system of an engine on a vehicle traveling on the road, comprising: expanding a fuel line volume of a fuel line of the engine coupled to a fuel injector to accommodate for increased fuel pressure after an engine shut-down during increasing fuel system temperature, and after said expanding, diminishing said fuel line volume to accommodate for decreased fuel pressure during decreasing fuel system temperature.

In one example, the expanding volume may be located downstream of a pressure regulation system, downstream of a carbon canister, or combinations thereof, for example. Also, the expanding/diminishing volume may be used with or without a fuel pressure regulator.

DETAILED DESCRIPTION

Figure 1:
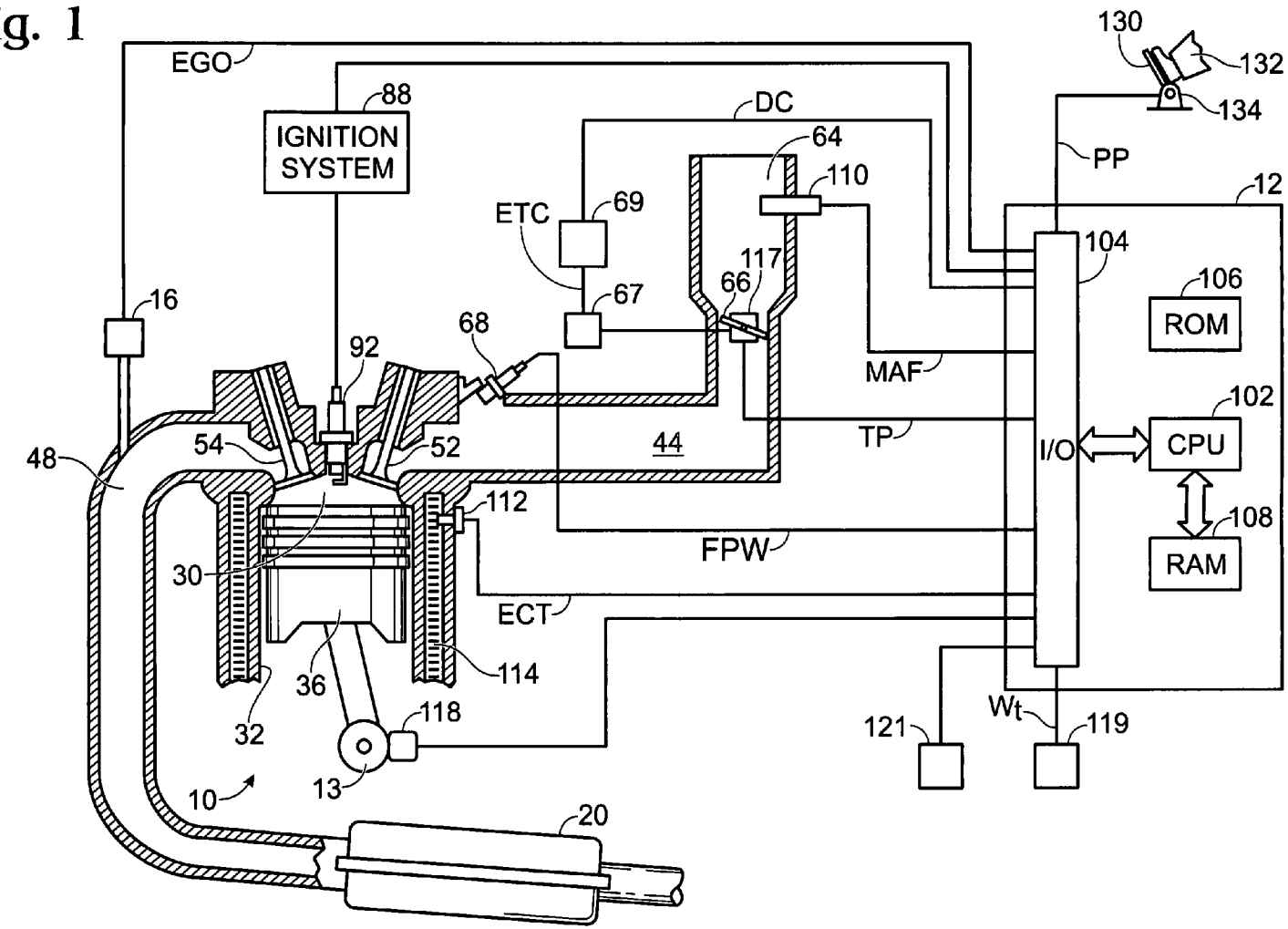
FIG. 1 is a block diagram of an engine.

Internal combustion engine 10, having a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 13. Combustion chamber 30 communicates with intake manifold 44 and exhaust manifold 48 via respective intake valve 52 and exhaust valve 54. Exhaust gas sensor 16 is coupled to exhaust manifold 48 of engine 10 upstream of catalytic converter 20. Exhaust gas sensor 16 corresponds to various different sensors known to those skilled in the art depending on the exhaust configuration.

Figure 2:
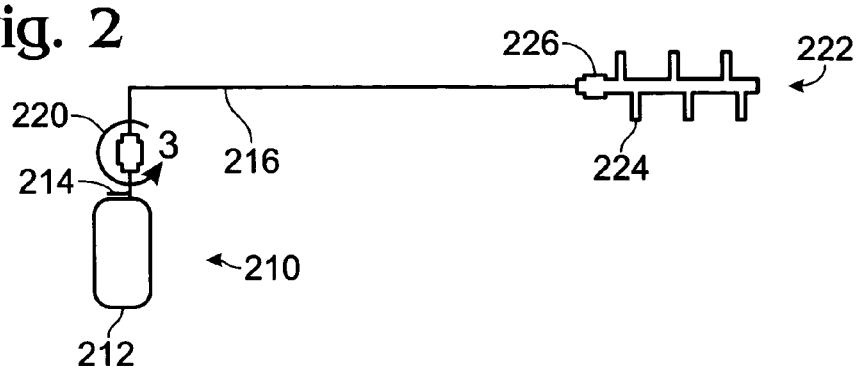
FIG. 2 is a block diagram of an example embodiment fuel system.

Intake manifold 44 communicates with throttle body 64 via throttle plate 66. Throttle plate 66 is controlled by electric motor 67, which receives a signal from ETC driver 69. ETC driver 69 receives control signal (DC) from controller 12. Intake manifold 44 is also shown having fuel injector 68 coupled thereto for delivering fuel in proportion to the pulse width of signal (fpw) from controller 12. Fuel is delivered to fuel injector 68 by a fuel system as shown in FIG. 2, including a fuel tank, fuel pump, and fuel rail. While FIG. 2 shows one example configuration, various other fuel systems may be used, such as return-type fuel system. Further, various types of evaporative emission systems may be used, such as those using carbon canisters, fuel vapor purge valve, etc.

Returning to FIG. 1, Engine 10 further includes conventional distributorless ignition system 88 to provide ignition spark to combustion chamber 30 via spark plug 92 in response to controller 12. In the example embodiment described herein, controller 12 is a microcomputer including: microprocessor unit 102, input/output ports 104, electronic memory chip 106, which is an electronically programmable memory in this particular example, random access memory 108, and a conventional data bus.

Controller 12 receives various signals from sensors coupled to engine 10, in addition to those signals previously discussed, including: measurements of inducted mass air flow (MAF) from mass air flow sensor 110 coupled to throttle body 64; engine coolant temperature (ECT) from temperature sensor 112 coupled to cooling jacket 114; a measurement of throttle position (TP) from throttle position sensor 117 coupled to throttle plate 66; a measurement of transmission shaft torque, or engine shaft torque from torque sensor 121, a measurement of turbine speed (Wt) from turbine speed sensor 119, where turbine speed measures the speed of a torque converter output shaft, and a profile ignition pickup signal (PIP) from Hall effect sensor 118 coupled to crankshaft 13 indicating an engine speed (We). Alternatively, turbine speed may be determined from vehicle speed and gear ratio. Accelerator pedal 130 communicates with the driver's foot 132. Accelerator pedal position (PP) is measured by pedal position sensor 134 and sent to controller 12.

In one example embodiment, the engine is coupled to a starter motor (not shown) for starting the engine. The started motor is powered when a driver turns a key in the ignition switch. The starter is disengaged after engine start as evidenced, for example by, engine 10 reaching a predetermined speed after a predetermined time.

While FIG. 1 shows engine 10 as a port fuel injected engine, in an alternative embodiment a direct fuel injection system may be used where fuel injector 68 is coupled in combustion chamber 30. In this case, the fuel system may be a low pressure system, a high pressure system, or a system having a low pressure side and a high pressure side.

FIG. 2 depicts an example fuel system having a fuel delivery module 210 with a jet pump 212 and a jet pump return line 214. In one example, a fuel system pressure relief valve 220 with an accumulator (such as described below herein with regard to FIGS. 3 and 4A and 4B) may be placed in line 216, for example. Alternatively, it may be placed on the fuel rail assembly 222 coupled to the engine upstream of the fuel injectors 224 of engine 10. In still another alternatively, it may be placed in a fuel tank. Further, various other locations may also be used. In one example, fuel delivery module 210 is located in a fuel tank (not shown). A fuel rail pressure sensor 226 is also shown coupled to the fuel rail assembly.

As noted above, engine 10 may be a port-fueled injected engine, direct injection engine (homogenous, stratified, or combinations thereof), or a diesel engine. In an alternate embodiment a carbon canister may be coupled in the fuel system upstream or downstream of the valve 220.

Figure 3:
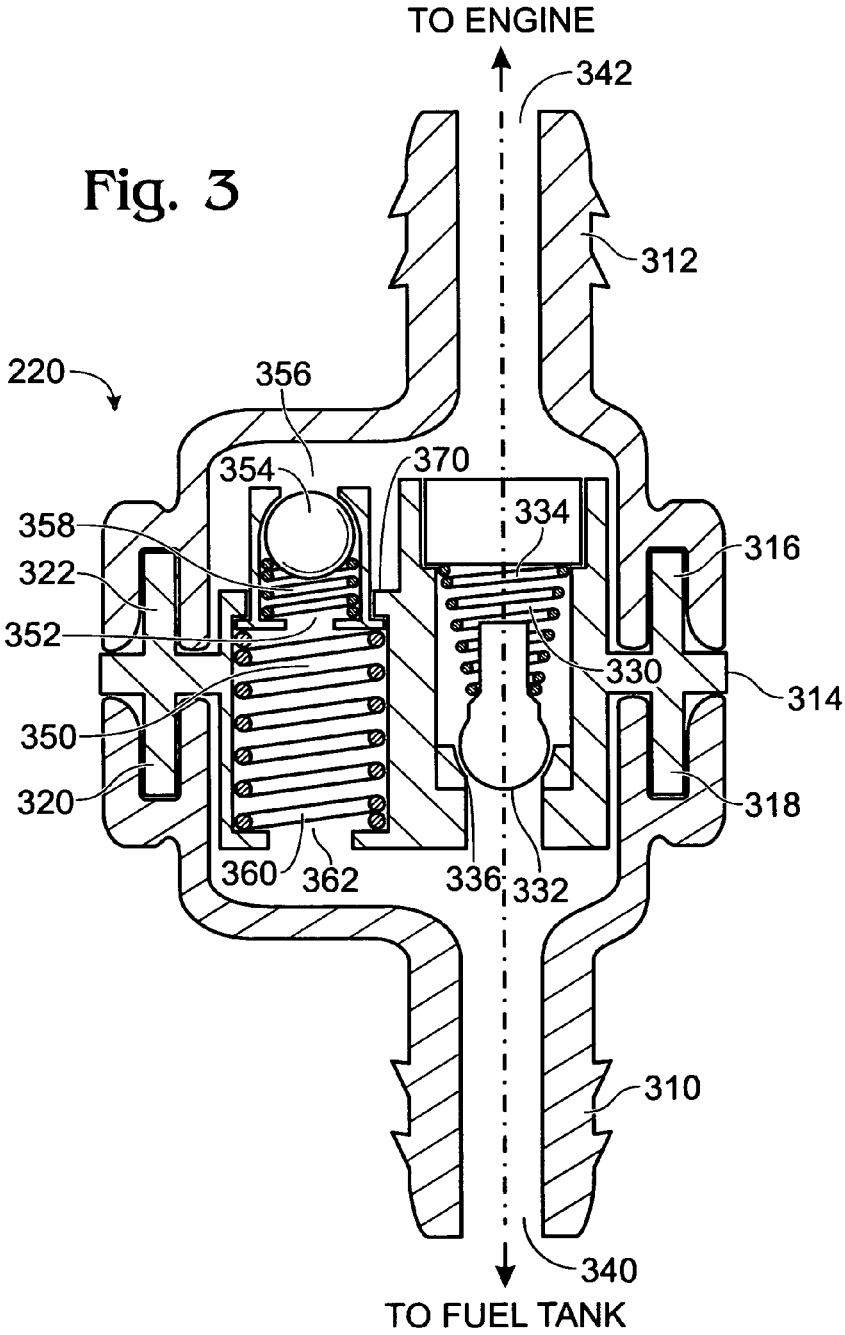
FIG. 3 is a schematic view of a fuel system pressure relief valve with accumulator.

FIG. 3 shows an enlarged view of an example valve 220. In this example, valve 220 is shown as an integrated valve assembly, although in an alternative embodiment, the parts and functions of valve 220 may be in separate components.

Continuing with FIG. 3, it shows upstream outer section 310 and downstream outer section 312. In this example, sections 310 and 312 are press fit together via intermediate section 314, with press fits at locations 316, 318, 320, and 322. Section 314 enables flow in two directions, as well as includes an accumulator function, as described in more detail below via a first ball spring assembly 330 and a second ball spring assembly 350.

Specifically, intermediate section 314 includes ball spring assembly 330, having ball piece 332 and spring 334 biasing piece 332 to close hole 336. Once the fuel pump is turned on to generate upstream fuel pressure, this pressure moves ball 332 to compress spring 334 thereby allowing fuel to flow from the entrance 340 to the exit 342, and thus to the engine 10. Ball spring assembly 330 prevents flow in the opposite direction (from the engine to the fuel tank) since such operation presses piece 332 into hole 336. In this way, assembly 330 may prevent or reduce back-flow from the fuel rail to the fuel tank.

Intermediate section 314 also includes ball spring assembly 350, which include ball spring sub-assembly 352 biased by spring 360 creating a capsule 362. Sub-assembly 352 includes a ball 354 biased over hole 356 by spring 358. In this way, sub-assembly 352 covers hole 356 to prevent flow from the fuel tank to the engine.

Alternatively, assembly 350 and sub-assembly 352 cooperate to relieve pressure on the engine side of valve 220 by providing the ability to accumulate pressure (e.g., by increasing the available volume). This is achieved by the ability of sub-assembly 352 moving to compress spring 360 in capsule 362 while ball 354 still seals hole 356. However, when the pressure on the engine side of sub-assembly 352 reaches a predetermined high pressure limit (e.g., when significant heat is generated by the shut-down engine to generate vapors in the fuel rail and associated lines), the ball moves to enable the high pressure to vent to the fuel tank side. Thus, sub-assembly 352 may provide pressure relief operation. This operation is described in more detail below with regard to FIGS. 4A–4B.

While FIG. 3 shows two parallel paths in a side-by-side configuration, the paths may be arranged concentrically, if desired. Further, the paths may be provided in separate parts, rather than single valve assembly 220.

Figure 4A:
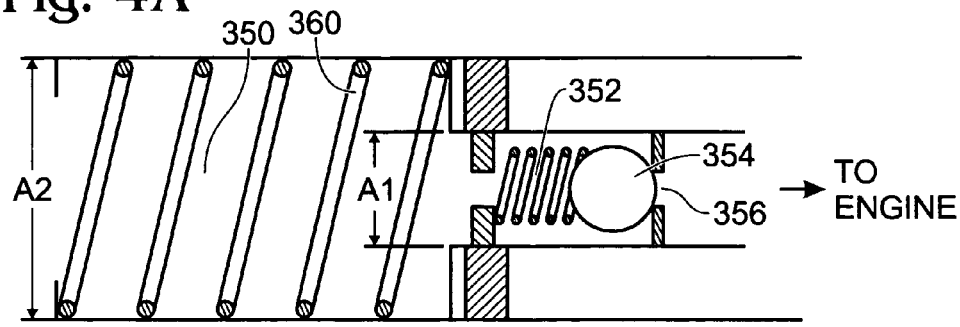
FIG. 4 is an example of the valve assembly during engine on (a) and engine off (b).
Figure 4B:
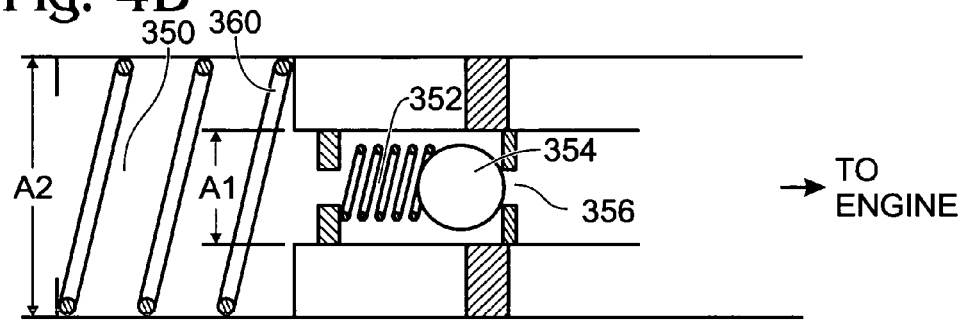

FIG. 4A depicts a schematic diagram of a portion of valve assembly 220 (assembly 350 and sub-assembly 352) under conditions when the fuel pump is on (e.g., engine 10 is running) and fuel is flowing from the tank, or pump, to the engine, while FIG. 4B depicts conditions when the fuel pump is off (e.g., engine is off), but increased temperature has caused an increase in the fuel line pressure on the engine side of valve 220.

Specifically, FIG. 4A shows assembly 352 compressing ball 354 over hole 356 and spring 360 in a relatively un-compressed state. Note that the amount of compression (or tension, or lack thereof) of spring 360 may be adjusted to achieve different levels of accumulation, as described herein. Assembly 352 is in a minimum accumulation position so that it is able to provide volume expansion once the engine is turned off, if desired. In one example, area 2 (A2) is greater than area 1 (A1) to provide that the sub-assembly 352 strokes full to ends 370 in preparation for the next engine shutdown. Thus, an accumulator, or storage capsule, can be considered substantially emptied during pump operation, although alternative designs may also be used. For example, partial emptying may be used.

FIG. 4B shows conditions after the engine is turned off, but increased temperature is generating vapor and/or pressure in the fuel lines. Here, sub-assembly 352 operates with residual fuel pressure in the lines of the fuel delivery system during hot soaks to stroke the sub-assembly 352 in the pressure relief capsule 362, filling the increased volume created by such movement. In this way, pressure relief may be provided by accumulation, or storage, of increased pressure in the spring 360 via additional volume created by the movement of sub-assembly 352 compressing spring 360. In one embodiment, this expansion may also decrease vapor space thereby decreasing vapor generation and evaporation.

In some conditions, this increased volume will temporarily compensate for the increased pressure, and then as the pressure subsides, the volume will be decreased so that the total amount of fuel in the line downstream of valve 220 is relatively unchanged. In other words, as underhood temperatures created by the engine 10 decrease, the sub-assembly 352 will return to its original position so that the spring 360 is unloaded to release pressure from the capsule 362 to tailor the decay profile as a function of time. This may provide the ability to control the rate of fuel system depressurization, decrease vapor generation, and allow the necessary pressure to be formed so that on subsequent ignition the correct pressure is available. This can reduce low fuel pressure conditions on subsequent restarts, thereby providing improved starting ability.

However, even with the additional volume available, under some conditions, heat continues to be generated after sub-assembly 352 has reached a maximum stroke. For example, under-hood heat transfer from the engine 10 may continue to cause a pressure rise in the fuel delivery system. In this case, the pressure relief mechanism of sub-assembly 352 (e.g., ball 354) will open at a predetermined level so that the fuel pressure within the system remains within specified values.

In one embodiment, sub-assembly 352 moving against spring 360 is one example type of accumulator that may be used. Alternatively, a separate capsule for accumulation may be provided.

As noted herein, the values of the spring rates, orifice sizes, areas, and spring pre-loading/pre-tensioning can be adjusted to provide varying functionality in terms of the amount of volume expansion for a given pressure change, the rate of pressure storage and/or release, and various other parameters. In the example above, this may be done without electrical actuation, although in another example electronic actuation may be used, if desired.

By providing the ability to store and then release pressure, it can be possible to provide operation of the valve assembly to accommodate for varying amounts of increasing and then decreasing fuel system temperature. In other words, it may be possible to reduce vapor generation by providing for expansion, and also reduce vacuum generation by providing for contraction. This can reduce vapor generation when the fuel system has positive pressure, high underhood temperatures, and heat rejection to the fuel system during hot soaks when the engine is not running.

Further, reducing vapor generation during hot soak periods may be more advantageous than trying to overcome inherent vapor generation that occurs during subsequent restarts by accumulating stored pressure to provide a boost to fuel pressure at a restart. However, in an alternative embodiment, stored pressure may be used during a re-start to boost fuel pressure, if desired.

Also, several of the embodiments described herein provide a way to control the rate of fuel system depressurization when the fuel pump is shut off, such as by a variable size accumulator volume. For example, spring 360 in cooperation with sub-assembly 352 can provide a restoring or resistive force via an accumulator piston when the fuel pump is off. Then, the system can adjust for pressure drops or volume contractions (e.g., due to cooling) when the fuel pump is off due to restoring force on the accumulator piston. Note, also, that there is no requirement that the fuel system pressure become negative before the compensation mechanism functions to reduce vapor space. Also, in various embodiments, the system is able to maintain pressure in the fuel system during engine off conditions, thereby reducing low pressure conditions (e.g. minimal (near zero) pressure on the fuel system during engine off periods). These conditions may result in increased vapor generation in the fuel delivery system due to high underhood temperatures and heat rejection to the fuel system during hot soaks when the engine is not running.

Figure 5:
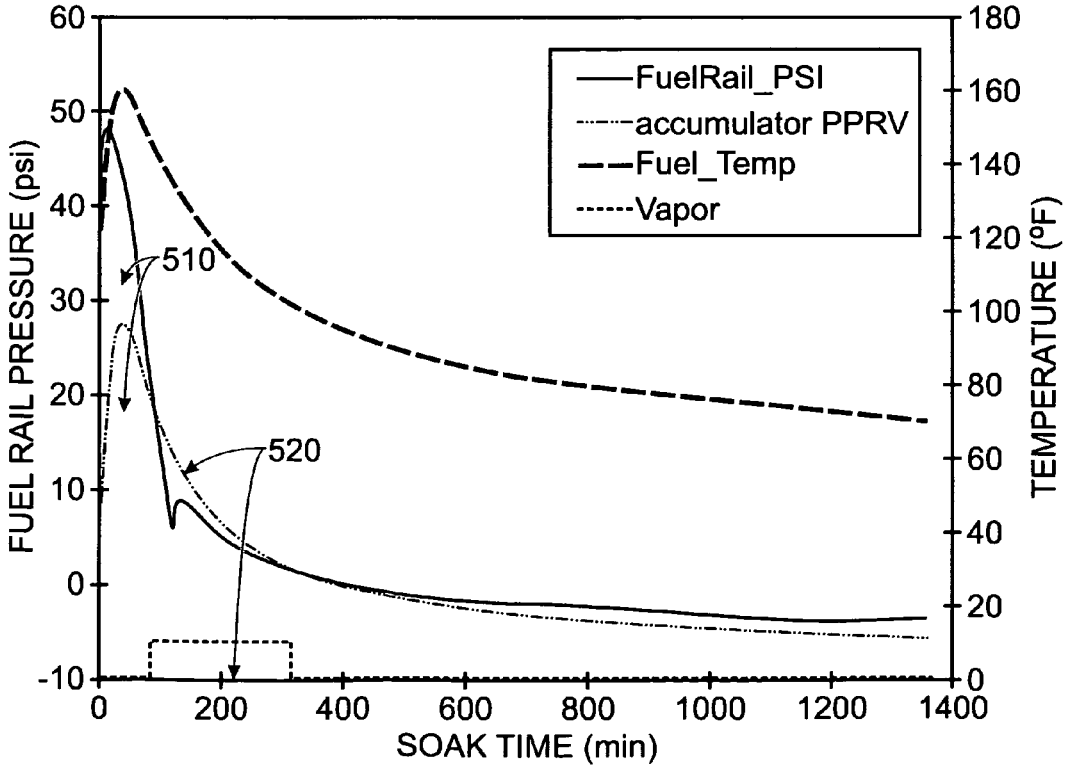
FIG. 5 is a graph depicting the fuel temperature profile and fuel system depressurization during engine-off hot soak with and without a pressure relief valve having an accumulator.

Referring now to FIG. 5, it depicts fuel temperature profile and fuel system depressurization during hot soak using an embodiment of the pressure relief valve with integral accumulator. The use of a pressure relief valve with accumulator, such as valve 220, decreases the overall pressure contributing to evaporation and eliminates, or reduces, a region of vapor generation. Specifically, FIG. 5 shows the fuel pressure with a prior art system (FuelRail_PSI) and with an example embodiment as shown herein (Accumulator PPRV). Specifically arrow 510 show the reduction in overall pressure contributing to evaporation, and arrow 520 shows the reduction of vapor (Vapor) for the given fuel temperature profile.

Figure 6:
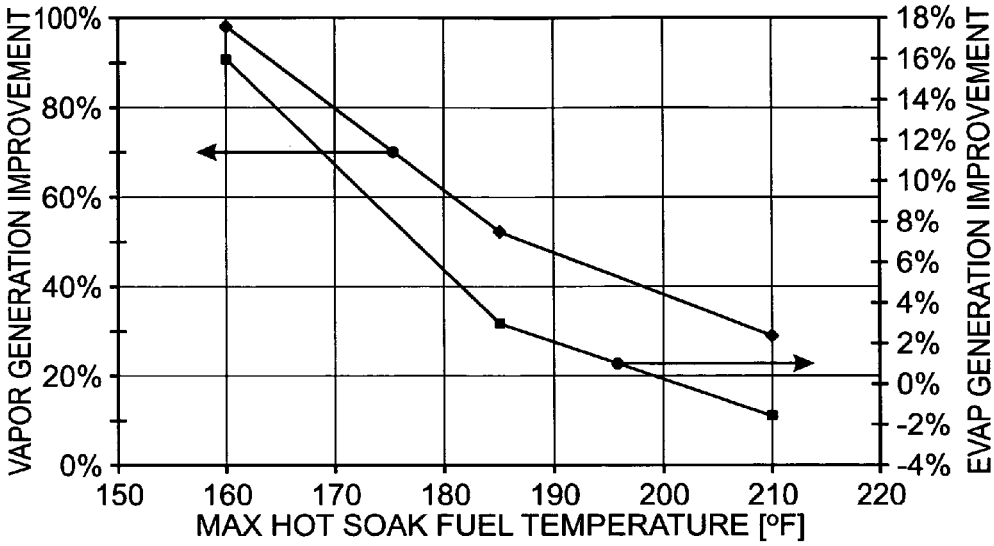
FIG. 6 is a graph depicting a decrease in vapor generation and evaporative emissions generation during a hot soak using a pressure relief valve mechanism with an accumulator in comparison to a prior art pressure relief valve.

Referring now to FIG. 6, it depicts a graph showing the decrease in vapor generation and evaporative emissions generation during hot soak using an embodiment of the pressure relief valve with accumulator, such as valve 220, in comparison with a prior art device. In this example, 12.6 RVP with 10% ethanol is used as the test fuel.

Figure 7:
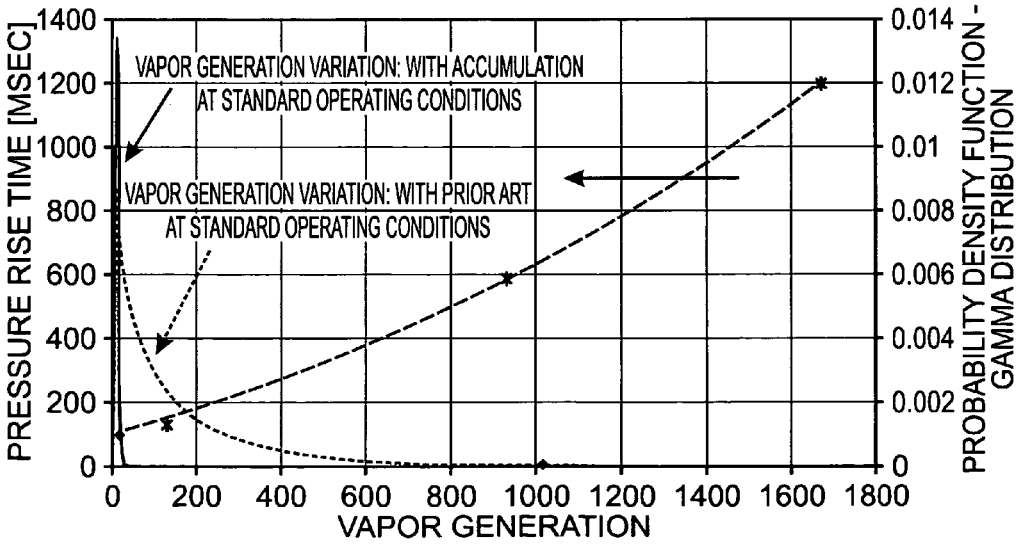
FIG. 7 is a graph depicting the relative variation in the amount of vapor generation and the corresponding fuel pressure rise time in the fuel line after engine ignition with and without a pressure relief valve with an accumulator.

Referring now to FIG. 7, it depicts the decrease in variation in the amount of vapor generation and the corresponding amount of time for a vehicle fuel system to reach desired pressure (e.g., 210 kPa, or 30 psi) using an embodiment of the pressure relief valve with accumulator, such as valve 220.

Figure 8:
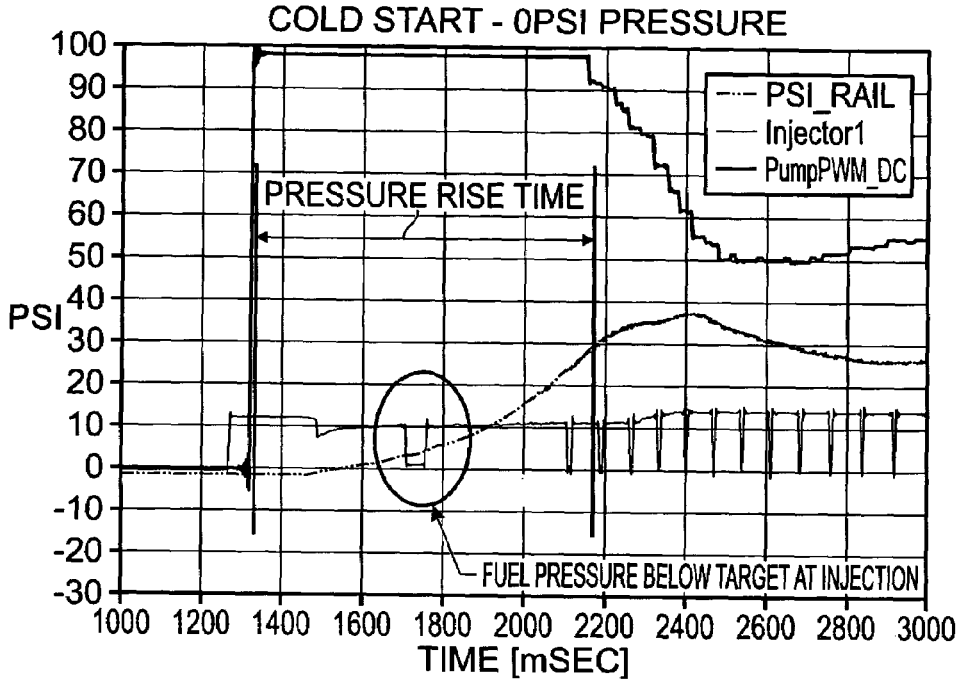
FIG. 8 is a graph depicting fuel pressure rise time from a cold start with a prior art pressure relief valve.
Figure 9:
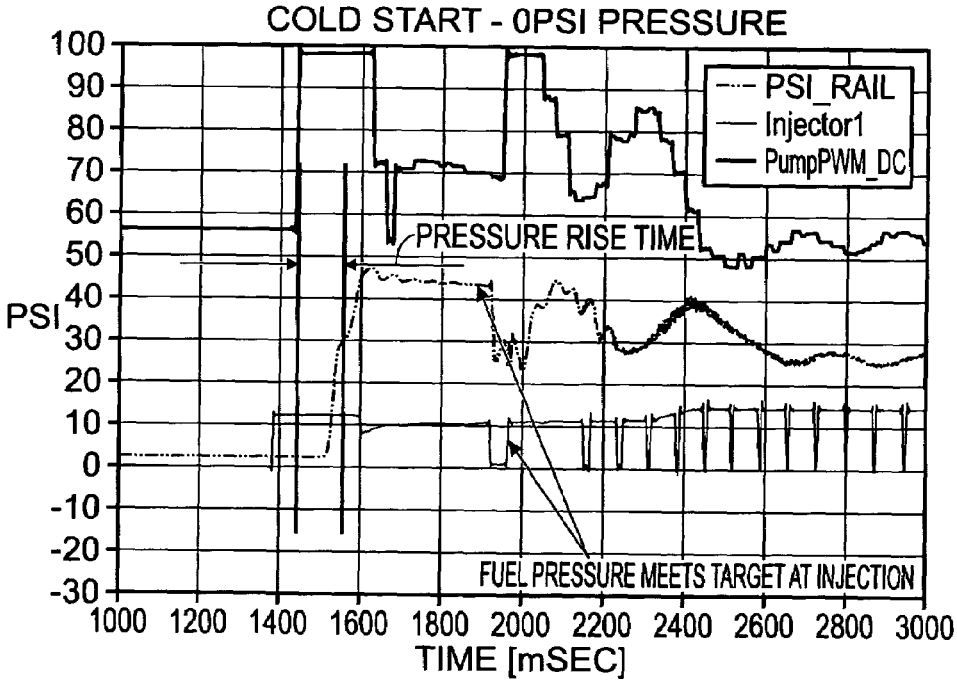
FIG. 9 is a graph depicting fuel pressure rise time from a cold start with using an embodiment of the pressure relief valve with an integral accumulator.
Figure 10:
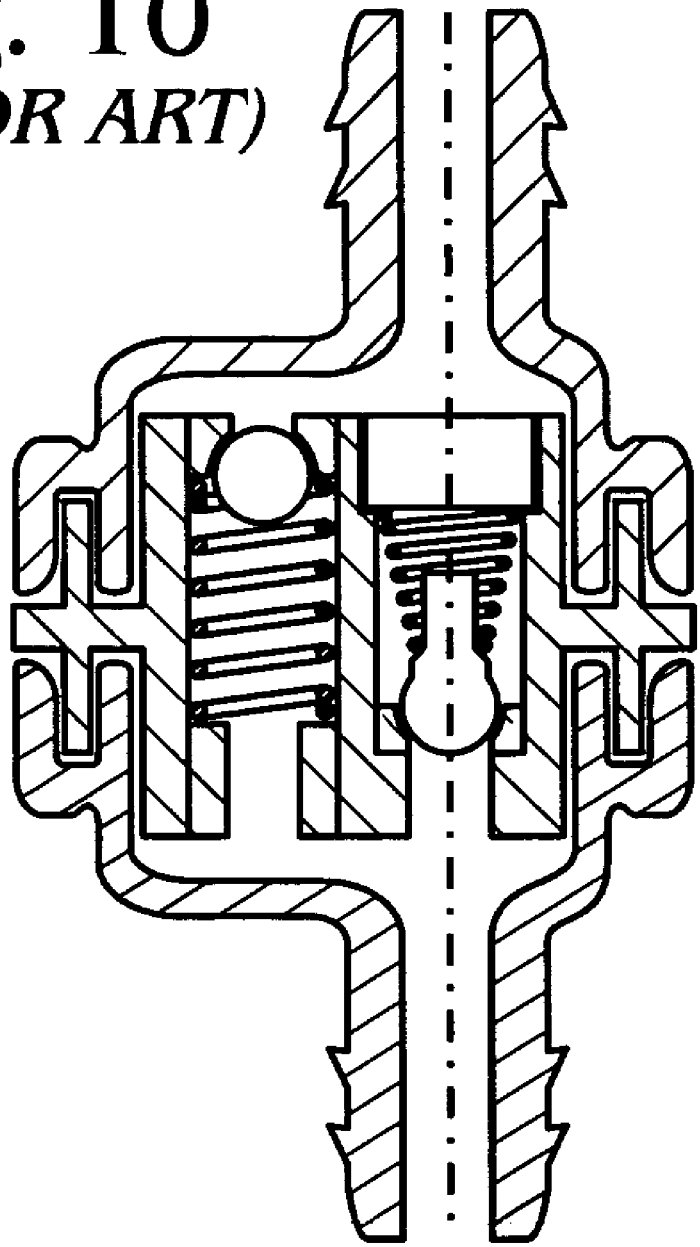
Fig. 10 (PRIOR ART)
FIG. 10 shows a prior art device.

Referring now to FIGS. 8–9, they show the amount of time required to reach desired pressure in a system in which there had been large vapor generation (FIG. 8) in comparison with a system using an embodiment of the valve 220 in which fuel pressure is at the desired level at the time of injection leading to smoother starts and decreased emissions upon start (FIG. 9). Specifically, the parameter PSI_RAIL shows the pressure in PSI at the rail, Injector1 shows the actuation of the injector for cylinder 1, and PumpPWM_DC shows the fuel pump duty cycle.

It will be appreciated that the configurations and routines disclosed herein are exemplary in nature, and that these specific embodiments are not to be considered in a limiting sense, because numerous variations are possible. For example, the above approaches can be applied to V-6, I-4, I-6, V-12, opposed 4, and other engine types. Also, the approaches described above are not specifically limited to any specific type of fuel system, but may be used with return or returnless fuel systems, high pressure fuel systems, low pressure fuel system, or duel pressure fuel system, for example.

The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

What is claimed is:

1. A fuel pressure relief system in an engine fuel system having a fuel line comprising:

a valve assembly intermediate the fuel line including a pressure relief valve and an accumulator coupled to the pressure relief valve, wherein the valve assembly provides a first flow path and wherein the accumulator is in communication with the engine side of the pressure relief valve at least during engine off conditions; and a back-flow valve intermediate the fuel line, wherein the back-flow valve provides a second flow path;

wherein the first and second flow paths are in parallel.

2. The fuel pressure relief system of claim 1, wherein the accumulator has a variable volume.

3. The fuel pressure relief system of claim 1, wherein the accumulator is stroked by residual fuel pressure upon engine shut-off.

4. The fuel pressure relief system of claim 1, wherein the accumulator releases pressure as the engine cools.

5. A fuel pressure relief system for a fuel line of an internal combustion engine, comprising:

a pressure relief valve for permitting fuel flow in a first direction during select couditions;

an expandable volume coupled to said pressure relief valve, said volume communicating with an engine side of said pressure relief valve;

a spring coupled to said expandable volume to control fuel pressure storage and release during engine off conditions; and a back-flow valve permitting fuel flow in a second direction during select conditions, said back-flow valve bypassing the pressure relief valve and expandable volume.

6. The system of claim 5, wherein the expandable volume is stroked to increase volume by residual fuel pressure during engine shut-off conditions.

7. The system of claim 5, wherein a pressure relief mechanism opens to release excess fuel pressure in the first direction.

8. The system of claim 7, wherein the expandable volume is stroked to a maximum volume prior to the opening of the relief mechanism.

9. An integrated valve assembly for a fuel delivery system of a vehicle engine, comprising:

an outer section having an entrance and an exit;

a first ball spring assembly within the outer section for allowing fuel to flow from the entrance to the exit during at least a first condition;

a second ball spring assembly within the outer section for allowing fuel to flow from the exit to the entrance during at least a second condition and an expandable capsule for capturing and releasing fuel pressure in a fuel line coupling the exit to the engine.

10. The valve assembly of claim 9, wherein the first ball spring assembly includes a first spring biasing a first ball piece to close a first hole through which fuel flows from the entrance to the exit.

11. The valve assembly of claim 10, wherein the second ball spring assembly includes a second spring biasing a second ball piece to close a second hole through which fuel flows from the exit to the entrance.

12. The valve assembly of claim 11, wherein the second ball spring assembly includes a third spring biasing the expandable capsule toward a minimum volume.

13. The valve assembly of claim 11, wherein the first spring is configured to allow fuel to flow from the entrance to the exit during the first condition, wherein the first condition includes a first fuel pressure at the entrance.

14. The valve assembly of claim 13, wherein the second spring is configured to allow fuel to flow from the exit to the entrance during the second condition, wherein the second condition includes a second fuel pressure at the exit, wherein the second fuel pressure is greater than the first fuel pressure.

15. The valve assembly of claim 14, wherein the third spring is configured to allow the expandable capsule to expand from the minimum volume toward a maximum volume at a third fuel pressure at the exit, wherein the third fuel pressure is less than the second fuel pressure.

16. The valve assembly of claim 9, wherein the first condition is during an engine on condition and the second condition is during an engine off condition.

17. The valve assembly of claim 9, wherein the outer section includes an upstream outer section including the entrance and a downstream outer section including the exit, and wherein the upstream outer section and the downstream outer section are press fit together via an intermediate section.

18. The valve assembly of claim 17, wherein the intermediate section defines the first hole and the second hole.

* * * * *